US011154177B1

(12) United States Patent
Johnson

(10) Patent No.: US 11,154,177 B1
(45) Date of Patent: Oct. 26, 2021

(54) MOP BUCKET ACCESSORIZING SYSTEM AND METHOD OF USE

(71) Applicant: Jarvis Johnson, Allen, TX (US)

(72) Inventor: Jarvis Johnson, Allen, TX (US)

( * ) Notice: Subject to any disclaimer, the term of this patent is extended or adjusted under 35 U.S.C. 154(b) by 0 days.

(21) Appl. No.: 15/686,813

(22) Filed: Aug. 25, 2017

Related U.S. Application Data

(60) Provisional application No. 62/477,702, filed on Mar. 28, 2017.

(51) Int. Cl.

| | |
|---|---|
| ***A47L 13/51*** | (2006.01) |
| ***B65D 25/04*** | (2006.01) |
| ***B65D 25/28*** | (2006.01) |
| ***B65D 25/22*** | (2006.01) |

(52) U.S. Cl.
CPC ..... *A47L 13/51* (2013.01); *B65D 25/04* (2013.01); *B65D 25/22* (2013.01); *B65D 25/2855* (2013.01)

(58) Field of Classification Search
CPC ..... A47L 13/51; B65D 25/22; B65D 25/04; B65D 25/2855
USPC ..... 206/223, 806
See application file for complete search history.

(56) References Cited

U.S. PATENT DOCUMENTS

D224,673 S * 8/1972 Brooks ..... D12/419
4,475,660 A * 10/1984 Cain ..... A47L 13/51 211/113
5,108,000 A * 4/1992 Stoll ..... B65F 1/00 206/806
D331,330 S * 12/1992 Bennett ..... D6/406.3
5,211,294 A * 5/1993 Garman ..... B25H 3/06 211/70.6
5,370,263 A * 12/1994 Brown ..... B25H 3/06 206/373
5,547,080 A * 8/1996 Klimas ..... B25H 3/02 182/129
5,673,885 A * 10/1997 Pham ..... E06C 7/14 182/129
5,881,891 A * 3/1999 Murphy, Jr. ..... A47L 13/51 211/65
5,983,441 A * 11/1999 Williams ..... A47L 13/58 15/260
6,311,841 B1 * 11/2001 Hodges ..... A45C 11/20 206/541
D484,701 S * 1/2004 Fabregas ..... D3/315
6,823,998 B2 * 11/2004 Fabregas ..... B25H 3/06 206/373
7,240,910 B2 * 7/2007 Stuemke ..... B62B 5/06 280/47.26
7,290,651 B2 * 11/2007 Irwin ..... A47L 13/51 206/216
7,431,313 B1 * 10/2008 Torres ..... B25H 3/00 280/124.12
7,878,364 B1 * 2/2011 Anderson ..... A47L 13/51 220/23.4

(Continued)

*Primary Examiner* — Steven A. Reynolds
(74) *Attorney, Agent, or Firm* — Leavitt Eldredge Law Firm

(57) ABSTRACT

A system of accessorizing a mop bucket by attaching a holder to its front edge. The holder having multiple compartments to accommodate spray bottles, rags or other supplies or implements. The holder is attached to the bucket by way of a connection device such as hangers, a strap or the like. A handle is attached to facilitate removal of the holder while the mop bucket is emptied.

3 Claims, 4 Drawing Sheets

(56) References Cited

U.S. PATENT DOCUMENTS

| | | | | |
|---|---|---|---|---|
| 8,181,974 | B1 * | 5/2012 | Galvan | B62B 3/10 280/47.19 |
| 8,376,376 | B2 * | 2/2013 | Thibault | A47L 13/58 280/79.11 |
| 9,682,471 | B2 * | 6/2017 | Jacobson | B25H 3/00 |
| 2005/0258002 | A1 * | 11/2005 | Sabo | E06C 7/14 182/129 |
| 2012/0228293 | A1 * | 9/2012 | Combs | A45F 5/02 220/200 |

* cited by examiner

MOP BUCKET ACCESSORIZING SYSTEM AND METHOD OF USE

BACKGROUND

1. Field of the Invention

The present invention relates generally to cleaning systems, and more specifically, to a mop bucket accessorizing system for efficiently carrying related cleaning supplies and implements with the aid of a rolling bucket.

2. Description of Related Art

Cleaning systems are well known in the art and are effective means to maintain spaces and objects free of dirt, clutter or other organizational discrepancies. For example, FIG. 1 depicts a conventional mop bucket device 101 having a bucket 103 mounted on wheels 105 with a squeezing apparatus 107 attached to the back edge 109. During use, the bucket is filled with water to dip a mop in. The mop is placed in the squeezing apparatus 107 to remove excess water. The wetted mop is then used to clean a floor.

One of the problems commonly associated with mop bucket 101 is its limited carry adaptability. For example, when cleaning a room the floor is only one part of the room that needs to be cleaned this results in the need of other treatments or implements to accomplish the task. Often times these additional supplies or implements are draped over the side or carried on the body of a user resulting in lower efficiency, injury or poor performance.

Accordingly, although great strides have been made in the area of mop buckets, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
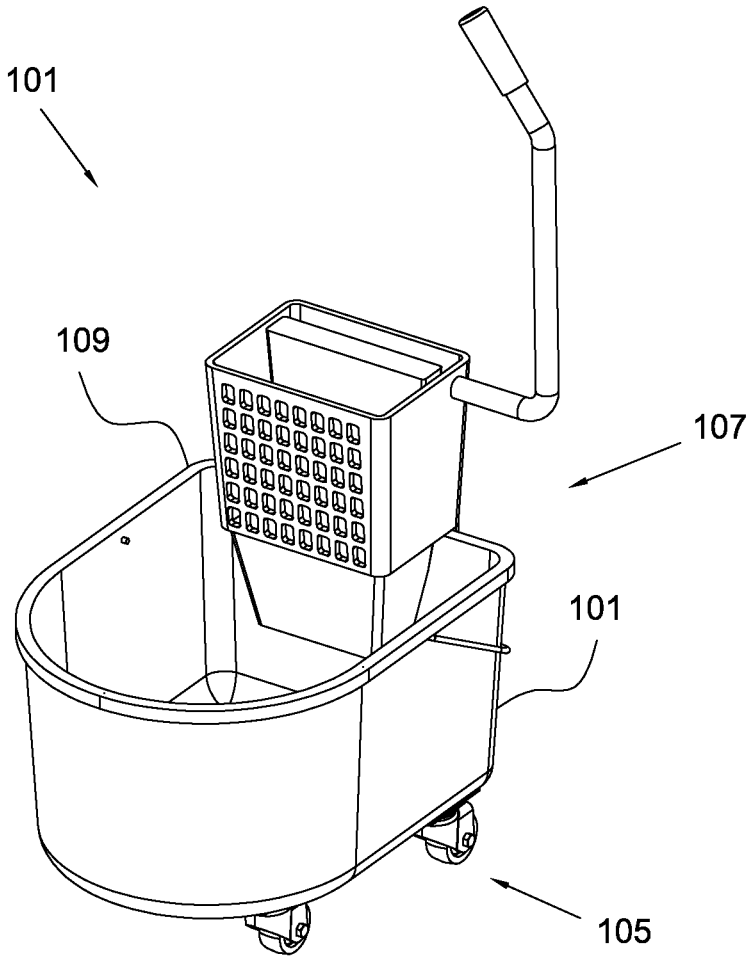
FIG. 1 (PRIOR ART)
FIG. 1 is a perspective view of a common mop bucket.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional mop buckets. Specifically, the system of the present application enables a user to carry additional supplies and implements to complete tasks associated with mopping a floor without the need to place them on the user's body. Additionally, the system prevents the additional implements from falling in the mop bucket while being carried. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
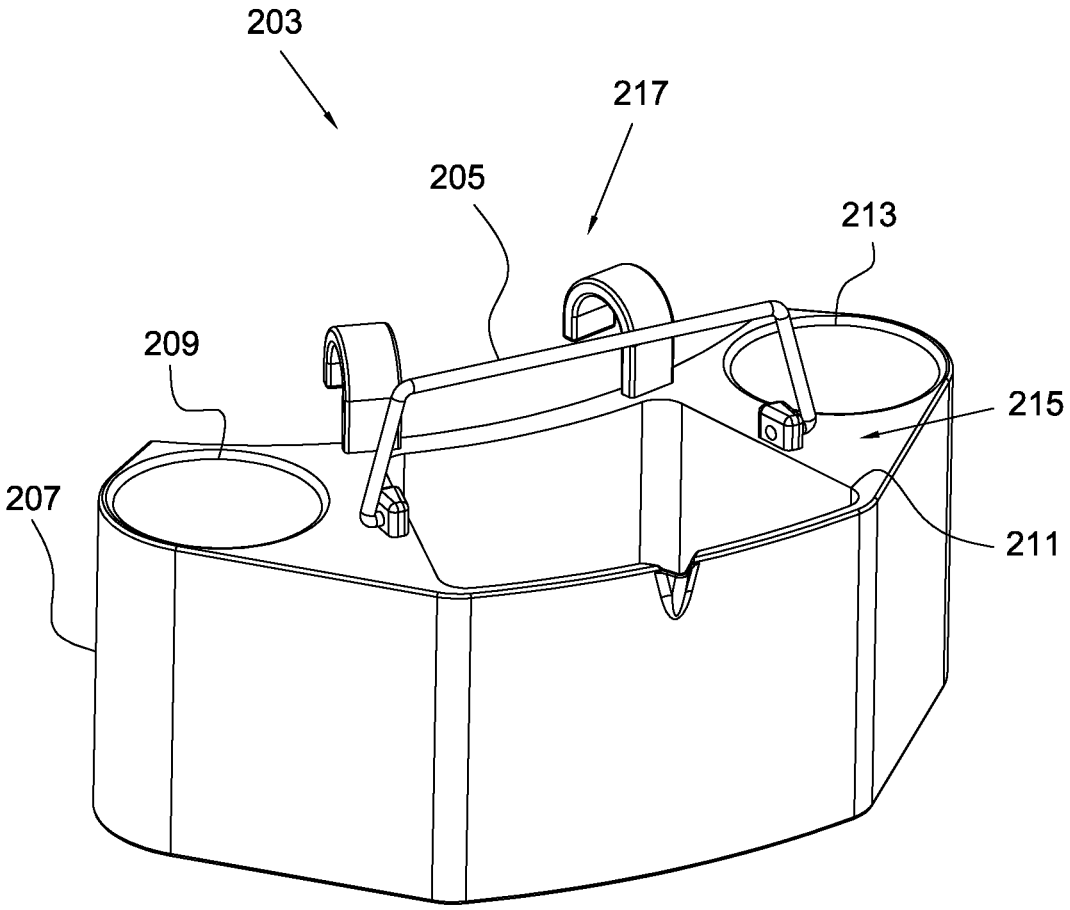
FIG. 2 is a perspective view of a mop bucket accessorizing system in accordance with a preferred embodiment of the present application.
Figure 3:
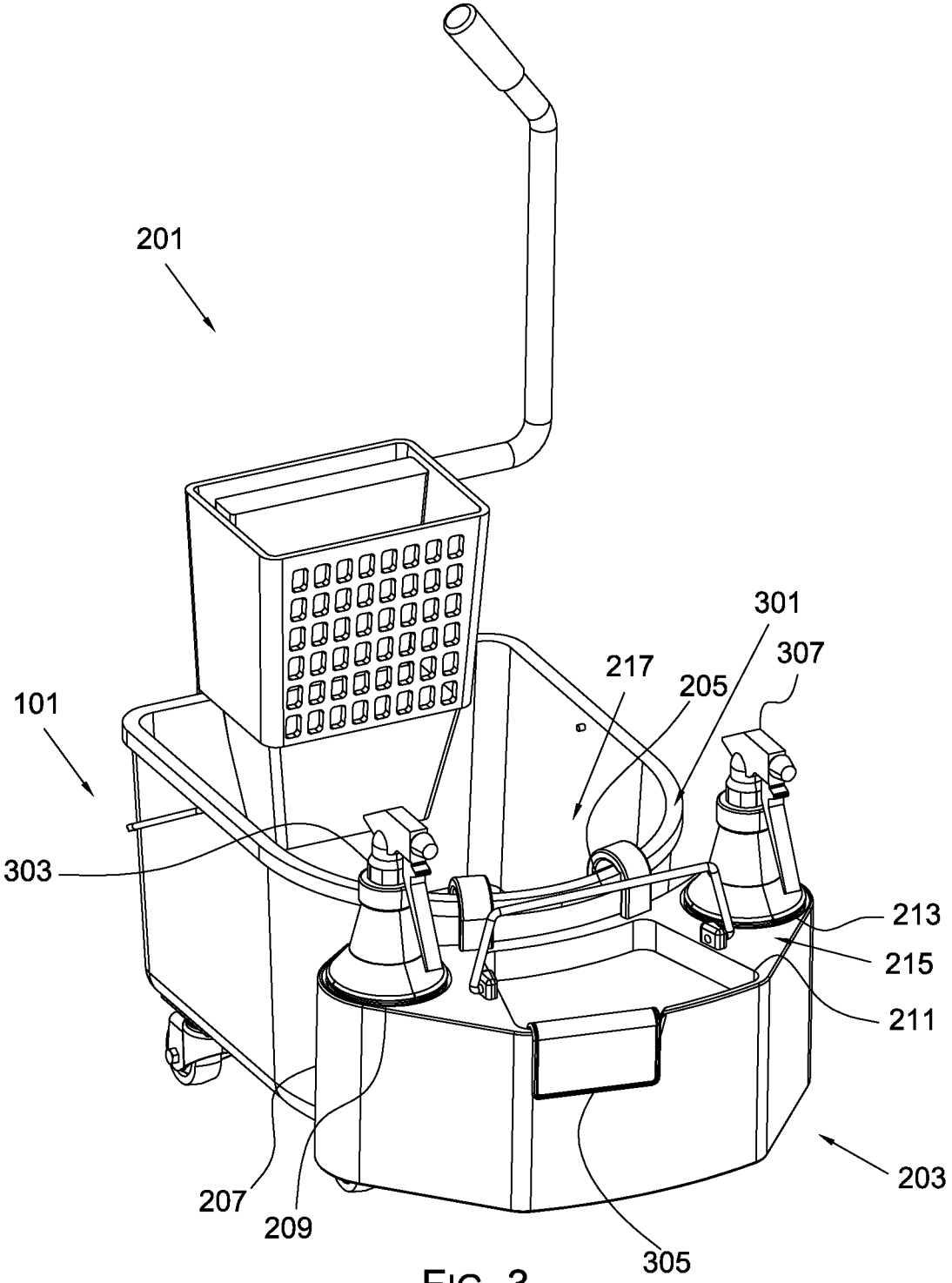
FIG. 3 is a perspective view of the system of FIG. 2 in use.

Referring now to the drawings wherein like reference characters identify corresponding or similar elements throughout the several views, FIGS. 2 and 3 respectively depict a perspective view of a mop bucket accessorizing system and the system in use, in accordance with a preferred embodiment of the present application. It will be appreciated that system 201 overcomes one or more of the above-listed problems commonly associated with conventional mop buckets.

In the contemplated embodiment, system 201 includes a holder 203 removably attached to the front edge 301 of a mop bucket 101. The holder 203 including a body 207 having a plurality of storage compartments 209, 211, 213 extending inward from the top surface 215. Each compartment is configured to store cleaning supplies such as spray bottles 303, rags 305, cleaning agents 307, chemicals or the like. The holder 203 also has a connecting device 217 rigidly attached to the body 207. The holder 203 is also equipped with a handle 205 rotationally attached to the body 207.

While the connection device 217 is depicted as hangers any means of connecting the holder 203 to the mop bucket 101 is contemplated. One additional example, having a belt attached to the body 207 of the holder 203 that wraps around the bucket 101 and attaches to itself.

In use, the holder 203 is attached to the mop bucket 101 as depicted in FIG. 3 via device 217. Additional supplies such as bottle 303, and rag 305 are placed in compartments 209 and 211 respectively. The mop bucket 101 is moved from location to location where the floors are mopped and other tasks such as cleaning the mirror are completed. It will be understood that any cleaning supplies could be placed in the holder 203 such as but not limited to rags, cleaning agents and chemicals.

It should be appreciated that one of the unique features believed characteristic of the present application is that compartments 209, 211, 213 are able to accommodate various cleaning supplies. It will also be appreciated that holder 203 facilitates movement of the mop bucket 101 by unencumbering the user to move the bucket 101 about. It will also be appreciated that handle 205 allows the holder 203 to be efficiently removed from the mop bucket 101 when emptying the bucket 101.

Figure 4:
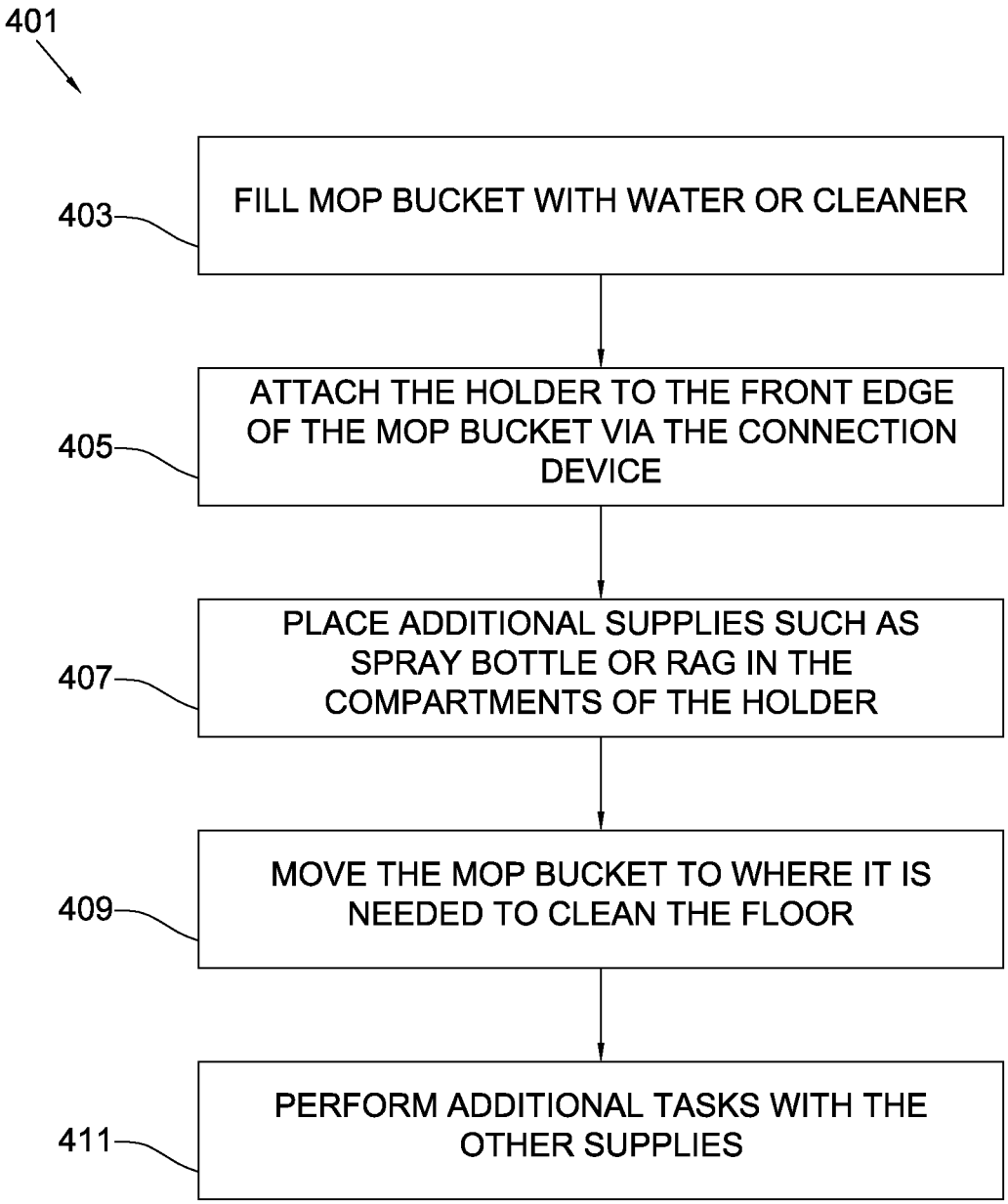
FIG. 4 is a flowchart of the preferred method of use of the system of FIG. 2.

Referring now to FIG. 4 the preferred method of use of system 201 is depicted. Method 401 including filling the mop bucket with water or cleaner 403, attaching the holder to the front edge of the mop bucket via the connection device 405, placing additional supplies such as a spray bottle, rag, cleaning agents or chemicals in the compartments of the holder 407, moving the mop bucket to where it is needed to clean a floor 409 and performing additional task with the other supplies 411.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A mop bucket accessorizing system comprising:

a holder removably attached to a front edge of a mop bucket, a front edge of the holder having a contouring configured to match an outer surface of the mop bucket, the holder further having a back edge, the holder including:

a plurality of compartments extending inward in a body from a top surface of the body, the plurality of compartments including:

a first cylindrical compartment configured to receive a first cylindrical bottle;

a second cylindrical compartment configured to receive a second cylindrical bottle;

a substantially rectangular compartment disposed between the first cylindrical compartment and the second cylindrical compartment;

wherein the back edge of the holder forms a back edge of the substantially rectangular compartment and tapers from the back edge of the substantially rectangular compartment to a first side edge of the first cylindrical compartment and a second side edge of the second cylindrical compartment;

a connection device rigidly attached to the body, the connection device is configured to removably engage with the front edge of the mop bucket, the connection device having a first hook and a second hook, the first hook and the second hook are positioned adjacent to the rectangular compartment; and a handle rotationally attached to the body and configured to extend over the rectangular compartment;

wherein the first hook and the second hook extend from the top surface of the body at a first front corner of the substantially rectangular compartment and a second front corner of the rectangular compartment; and wherein the compartments store additional cleaning supplies or implements to facilitate performing additional tasks associated with mopping a floor.

2. The system of claim 1, wherein the handle is attached at a first side of the rectangular compartment and a second side of the substantially rectangular compartment such that the handle extends over the substantially rectangular compartment.

3. The system of claim 1, further comprising:

an indention cut into the back edge of the substantially rectangular compartment.

* * * * *